US010487829B2

(12) United States Patent
Kinoshita et al.

(10) Patent No.: US 10,487,829 B2
(45) Date of Patent: Nov. 26, 2019

(54) ON-VEHICLE ELECTRIC COMPRESSOR HAVING A PROTECTING MEMBER PROTECTING A COVER FOR A MOTOR DRIVING CIRCUIT AGAINST AN EXTERNAL FORCE CAUSED WHEN A VEHICLE HAS A COLLISION

(71) Applicant: KABUSHIKI KAISHA TOYOTA JIDOSHOKKI, Kariya-shi, Aichi-ken (JP)

(72) Inventors: Yusuke Kinoshita, Aichi-ken (JP); Ken Suitou, Aichi-ken (JP); Tatsuya Koide, Aichi-ken (JP); Junya Yano, Aichi-ken (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 101 days.

(21) Appl. No.: 14/975,813

(22) Filed: Dec. 20, 2015

(65) Prior Publication Data

US 2016/0185188 A1 Jun. 30, 2016

(30) Foreign Application Priority Data

Dec. 25, 2014 (JP) ..... 2014-263671

(51) Int. Cl.
*F04C 18/02* (2006.01)
*F01C 21/10* (2006.01)
(Continued)

(52) U.S. Cl.
CPC ..... *F04C 18/0215* (2013.01); *F01C 21/10* (2013.01); *F04C 23/008* (2013.01); *F04C 28/28* (2013.01); *F04C 2240/808* (2013.01)

(58) Field of Classification Search
CPC ..... F04B 39/12; F04B 39/121; F04B 35/04; F01C 21/10; H02K 2213/06; H02K 7/14;
(Continued)

(56) References Cited

U.S. PATENT DOCUMENTS 8,464,546 B2 6/2013 Minami
8,777,593 B2 7/2014 Kinoshita et al.
(Continued)

FOREIGN PATENT DOCUMENTS

JP 2009-085082 A 4/2009
JP 2009-103100 A 5/2009
JP 2014-031738 A 2/2014

*Primary Examiner* — Essama Omgba
*Assistant Examiner* — Stephen A Mick
(74) *Attorney, Agent, or Firm* — Sughrue Mion, PLLC

(57) ABSTRACT

An on-vehicle electric compressor for a vehicle includes a compression mechanism compressing a refrigerant, an electric motor driving the compression mechanism and a housing accommodating therein the compression mechanism and the electric motor. The on-vehicle electric compressor further includes a cover fixed to the housing, a motor driving circuit disposed between the housing and the cover and driving the electric motor, and a protecting member protecting the cover against an external force caused when the vehicle has a collision. The protecting member has a contact portion that is contactable with a receiving portion when the external force is applied to the protecting member, the receiving portion having a greater rigidity than the cover to receive the external force through the contact portion.

6 Claims, 3 Drawing Sheets

(51) Int. Cl.
*F04C 23/00* (2006.01)
*F04C 28/28* (2006.01)

(58) Field of Classification Search
CPC ..... H02K 5/04; H02K 11/33; F04C 18/0215; F04C 18/344; F04C 23/008; F04C 28/28; F04C 29/0085; F04C 2240/808; F04C 18/356
USPC ..... 417/363
See application file for complete search history.

(56) References Cited

U.S. PATENT DOCUMENTS

| | | | | |
|---|---|---|---|---|
| 9,068,458 | B2 | 6/2015 | Ota et al. | |
| 2003/0143056 | A1* | 7/2003 | Miura | F16B 5/02 411/386 |
| 2006/0230781 | A1* | 10/2006 | Kawada | F04B 35/04 62/498 |
| 2010/0226800 | A1 | 9/2010 | Ichise et al. | |
| 2011/0133575 | A1* | 6/2011 | Arashi | B60H 1/3229 307/326 |
| 2012/0237376 | A1* | 9/2012 | Kinoshita | F01C 21/10 417/423.7 |
| 2012/0251356 | A1* | 10/2012 | Ota | F01C 21/10 417/410.1 |

* cited by examiner

ON-VEHICLE ELECTRIC COMPRESSOR HAVING A PROTECTING MEMBER PROTECTING A COVER FOR A MOTOR DRIVING CIRCUIT AGAINST AN EXTERNAL FORCE CAUSED WHEN A VEHICLE HAS A COLLISION

BACKGROUND OF THE INVENTION

The present invention relates to an on-vehicle electric compressor.

Japanese Patent Application Publication no. 2009-85082 discloses an on-vehicle electric compressor adapted for use in a vehicle air conditioner. In general, the on-vehicle electric compressor includes a housing accommodating therein a compression mechanism that compresses a refrigerant gas and an electric motor that drives the compression mechanism. The housing has on part of the outer surface thereof a cover. A motor driving circuit that drives the electric motor is disposed between the housing and the cover.

If the cover of the on-vehicle electric compressor is deformed by application of any external force due to vehicle collision, there is fear that the motor driving circuit may be damaged because of the contact with the deformed portion. The on-vehicle electric compressor of the above-cited Publication includes a protector provided in the cover to prevent the cover from the deformation caused by vehicle collision and hence to protect the motor driving circuit successfully against the damage caused by the deformed cover, as compared with the case in which the cover has no such protector.

However, in the electric compressor for a vehicle of the above-cited Publication wherein external force applied to the protector is received by the cover, the cover may be deformed by the external force transmitted through the protector, with the result that the motor driving circuit may be damaged by contact of the deformed cover.

The present invention, which has been made in light of the above problem, is directed to providing an on-vehicle electric compressor in which a motor driving circuit is protected against damage caused by external force.

SUMMARY OF THE INVENTION

In accordance with an aspect of the present invention, there is provided an on-vehicle electric compressor including a compression mechanism compressing a refrigerant, an electric motor driving the compression mechanism and a housing accommodating therein the compression mechanism and the electric motor. The on-vehicle electric compressor further includes a cover fixed to the housing, a motor driving circuit disposed between the housing and the cover and driving the electric motor, and a protecting member protecting the cover against an external force caused when the vehicle has a collision. The protecting member has a contact portion that is contactable with a receiving portion when the external force is applied to the protecting member, the receiving portion having a greater rigidity than the cover to receive the external force through the contact portion.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
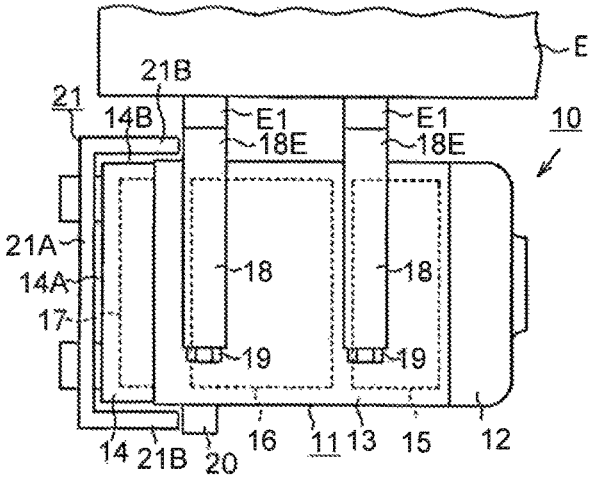
FIG. 1 is a schematic view of an on-vehicle electric compressor mounted in an engine compartment of a vehicle according to an embodiment of the present invention.
Figure 2:
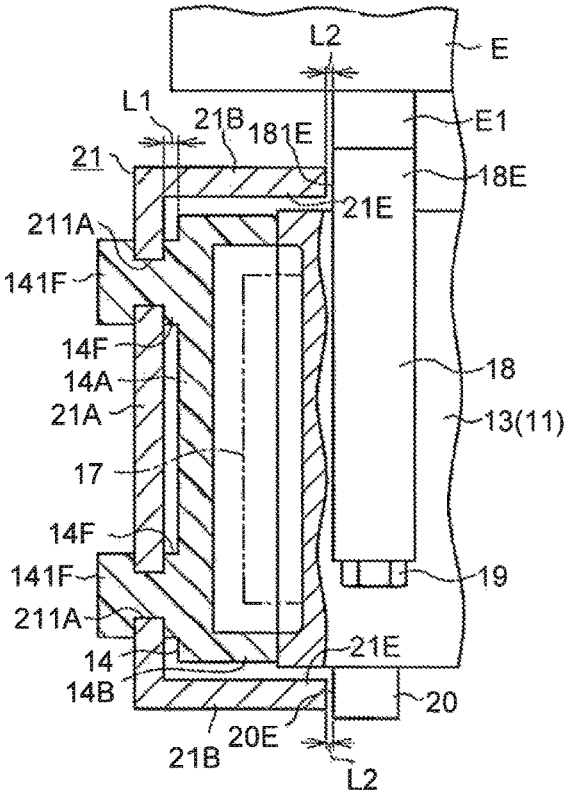
FIG. 2 is a partially enlarged cross-sectional view of the on-vehicle electric compressor of FIG. 1.

The following will describe an embodiment of the present invention with reference to FIGS. 1 through 3. Referring to FIG. 1, there is shown an on-vehicle electric compressor 10 (hereinafter referred to as compressor 10) that is adapted for use in an air conditioner and an engine E that is mounted in an engine compartment of the vehicle has mounting portions E1 projecting from the engine E. The compressor 10 is disposed in the engine compartment and fixed to the engine E through the mounting portions E1.

The compressor 10 includes a housing 11 that is composed of a covered cylindrical discharge housing 12 and a bottomed cylindrical suction housing 13 that are connected to each other. The discharge housing 12 and the suction housing 13 are both made of a metal such as aluminum. A cover 14 that is made of a resin and has a cylindrical shape is fixed to the suction housing 13. The cover 14 includes a bottom wall 14A and a peripheral wall 14B that is formed extending perpendicularly from the bottom wall 14A.

The suction housing 13 accommodates therein a compression mechanism 15 that compresses a refrigerant gas and an electric motor 16 that drives the compression mechanism 15, Although not shown in the drawing, the compression mechanism 15 includes a fixed scroll that is fixed to the suction housing 13 and a movable scroll that is disposed in a facing relation to the fixed scroll.

A motor driving circuit 17 that drives the electric motor 16 is disposed between the suction housing 13 and the cover 14. In the compressor 10 of the present embodiment, the compression mechanism 15, the electric motor 16 and the motor driving circuit 17 are disposed in this order along a longitudinal or axial direction of the housing 11.

The suction housing 13 is formed with a plurality of mounting legs 18 (two mounting legs being shown in FIG. 1) of square shape in cross section and having therein a bolt hole (not shown). Each mounting leg 18 extends perpendicularly to the axial direction of the housing 11 and projects out from the outer peripheral surface of the suction housing 13. The compressor 10 is fixedly mounted to the engine E by bolts 19 that are inserted through the bolt holes in the mounting legs 18 and screwed into the mounting portions E1 of the engine E. As shown in FIG. 1, the mounting leg 18 extends beyond the outer periphery of the suction housing 13. That is, the end portion 18E of the mounting leg 18 at the end thereof opposite to the head of the bolt 19 inserted in the bolt hole is located beyond the outer periphery of the suction housing 13.

In addition, the suction housing 13 is formed with a projection 20 of a square pillar extending in axial direction of the mounting leg 18 from the outer peripheral surface of the suction housing 13. The projection 20 is formed at a position that corresponds to the mounting leg 18 located most adjacent to the cover 14 in circumferential direction of the suction housing 13 and is on the side of the suction housing 13 that is opposite from the end portion 18E of the mounting leg 18.

As shown in FIG. 2, the end portion 18E of the mounting leg 18 that is disposed most adjacent to the cover 14 has a surface 181E and the projection 20 has a surface 20E, and these surfaces 181E and 20E are formed in the same imaginary plane extending across the suction housing 13. The mounting leg 18 and the projection 20 are made of a metal having a higher rigidity than the cover 14.

The cover 14 is provided with a protecting member 21 that is made of a metal and protects the cover 14 against external force caused when the vehicle has a collision. The protecting member 21 includes a first protecting portion 21A of a plate shape that is disposed axially outward of the bottom wall 14A of the cover 14 and a pair of second protecting portions 21B of a plate shape that extends from the bottom wall perpendicularly to the first protecting portion 21A and have the peripheral wall 14B of the cover 14 disposed therebetween. The first protecting portion 21A and the second protecting portion 21B cover at least a part of the bottom wall 14A and the peripheral wall 14B of the cover 14, respectively. One second protecting portion 21B extends proximate to the surface 181E of the end portion 18E of the mounting leg 18 that is arranged most adjacent to the cover 14. The other second protecting portion 21B extends proximate to the surface 20E of the projection 20. Thus, the paired second protecting portions 21B are arranged radially outward of the peripheral wall 14B.

The cover 14 includes a plurality of seats 14F projecting out from the outer surface of the bottom wall 14A. The first protecting portion 21A of the protecting member 21 is placed on the seats 14F. The first protecting portion 21A has therethrough at positions corresponding to the respective seats 14F a plurality of holes 211A through which the seat 14F extends. The seat 14F of the cover 14 has a protruded portion 141F on the side of the first protecting portion 21A that is opposite from the cover 14. Thus, the first protecting portion 21A of the protecting member 21 is held around the hole 211A thereof between the seat 14F and the protruded portion 141F of the cover 14. In other words, the part of the first protecting portion 21A around the hole 211A is held by the cover 14 so that the protecting member 21 and the cover 14 are integrated.

Referring to FIG. 2, L1 indicates the spaced distance between the outer surface of the bottom wall 14A of the cover 14 and the inner surface of the first protecting portion 21A of protecting member 21 or the dimension of the seat from the outer surface of the bottom wall 14A, and L2 the spaced distance between the end portion 21E of the second protecting portion 21B of the protecting member 21 and the surface 181E of the mounting leg 18, or surface 20E of the projection 20 that is measured any external force is applied to the protecting member 21. In other words, L2 indicates the spaced distance between the contact portion and the receiving portion. In the compressor 10 of the present embodiment, L1 is greater than L2.

Figure 3A:
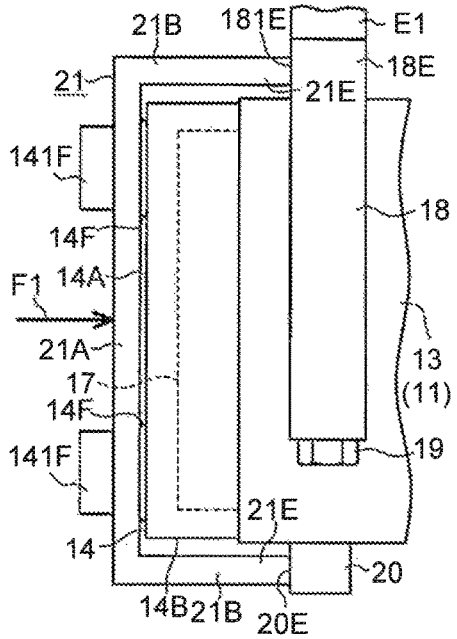
FIGS. 3A and 3B are partial schematic diagrams showing two states in which an external force is applied to a protecting member of the on-vehicle electric compressor of FIG. 1.

The following will describe the operation of the compressor 10 according to the present embodiment. Referring to FIG. 3A, if external force F1 caused by collision of vehicle is applied to the protecting member 21, the external force F1 is transmitted through the protecting member 21 and deforms the seat 14F. Consequently, the protecting member 21 is displaced toward the mounting leg 18 that is disposed most adjacent to the cover 14 and the projection 20 for an amount corresponding to the deformation of the seat 14F until the end portions 21E of the second protecting portions 21B of the protecting member 21 are brought into contact with the surface 181E of the mounting leg 18 and surface 20E of the projection 20, respectively. Thus, the external force F1 applied to the protecting member 21 is transmitted through the end portions 21E of the second protecting portions 21B and received by the mounting leg 18 and the projection 20.

Therefore, the end portions 21E of the second protecting portions 21B function as contact portions that are contactable with the mounting leg 18 and the projection 20 when the external force F1 is applied to the protecting member 21. Thus, the suction housing 13 has the mounting leg 18 and the projection 20 that function as receiving portions having a higher rigidity than the cover 14. This configuration protects the cover 14 from damage by the external force F1 transmitted through the protecting member 21 and hence prevents the motor driving circuit 17 from damage caused by contact of the deformed cover 14.

Figure 3B:
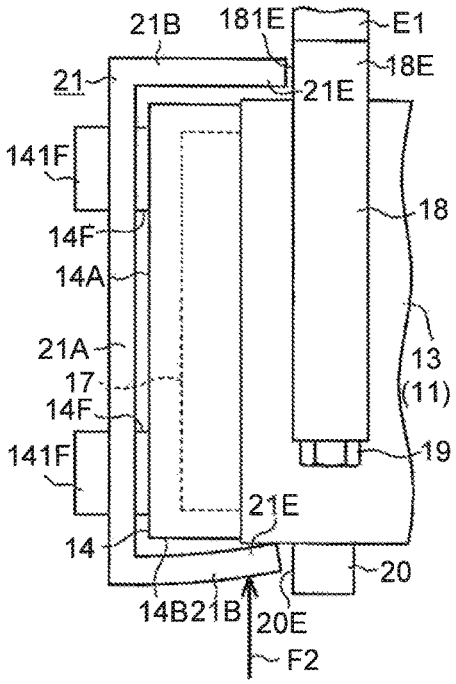

If external force F2 caused by collision of vehicle is applied to the protecting member 21, the other second protecting portion 21B is bent toward the suction housing 13 about the corner of the protecting member 21 between the second protecting portion 21B and the first protection portion 21A, as shown in FIG. 3B. Thus, the end portion 21E of the second protecting portion 21B is brought into contact with the outer peripheral surface of the suction housing 13, so that the external force F2 applied to the protecting member 21 and transmitted through the end portion 21E of the other second protecting portion 21B is received by the suction housing 13. Thus, the suction housing 13 functions as receiving portion having a greater rigidity than the cover 14. In this way, the cover 14 is protected against the external force F2 transmitted through the protecting member 21 and hence against the deformation. As a result, the motor driving circuit 17 is protected against damage caused by contact of the deformed cover 14.

The present invention offers following effects.

(1) The protecting member 21 includes a pair of the second protecting portions 21B having the respective end portions 21E functioning as the contact portions that are contactable with the mounting leg 18 and the projection 20 having a greater rigidity than the cover 14 and, respectively, in the event of application of external force F1, F2 to the protecting members 21 caused by collision of vehicle. According to such configuration, the external force F1, F2 applied to the protecting member 21 and transmitted through the end portions 21E of the protecting members 21 is received by the mounting leg 18, the projection 20 and the suction housing 13. This prevents the external force F1 F2, which may otherwise deform the cover 14, from being transmitted to the cover 14. As a result, the motor driving circuit 17 is protected against damage caused by contact of the deformed cover 14.

(2) The paired second protecting portions 21B of the protecting member 21 are disposed radially outward of the cover 14 and having the end portions 21E that act as the contact member. In the event that the external force F1 is applied to the protecting member 21, the end portions 21E of the second protecting portions 21B are brought into contact with the corresponding mounting leg 18 and the projection 20 disposed at positions that are radially outward of the peripheral wall 14B. This prevents uneven load to the protecting member 21 and permits increasing the durability of the protecting member 21.

(3) The suction housing 13 has the mounting legs 18 and the projection 20 that have greater rigidity than the cover 14 and function as the receiving portions. This prevents the external forces F1, F2 from being transmitted to nearby parts of the compressor 10 including the engine E, with the result that the external forces F1, F2 are less likely to cause undesirable effect to the nearby parts of the compressor 10.

(4) The spaced distance L1 between the outer surface of the bottom wall 14A of the cover 14 and the inner surface of the first protecting portion 21A of protecting member 21 is formed greater than the spaced distance L2 between the end portions 21E of the second protecting portions 21B of the protecting member 21 and their corresponding surface 181E of the mounting leg 18 and the surface 20E of the projection 20. The external force F1 applied to the protecting member 21 and transmitted through the protecting member 21 deforms the seat 14F. In this case, the end portions 21E of the second protecting portions 21B are brought into contact with the surface 181E of the mounting leg 18 and the surface 20E of the projection 20 before the protecting member 21 comes into contact with the outer peripheral surface of bottom wall 14A. This prevents the external force F1 from being transmitted to the bottom wall 14A, thereby minimizing the deformation of the cover 14. This allow helps to prevent the damage to the motor driving circuit 17 caused by contact thereof with the deformed cover 14 more effectively.

(5) The cover 14 is made of a resin and part of the protecting member 21 is held by the cover 14 so that the protecting member 21 and the cover 14 are integrated. This permits easy mounting of the protecting member 21 to the cover 14 without using any fastening part such as bolt. Because no mounting part is required, the number of parts and weight of compressor 10 may be reduced.

(6) In a case in which the protecting member such as 21 is mounted to the housing 11, the protecting member needs to extend from the housing 11 to a position where it can protect the cover 14, which makes the protecting member larger. In the present embodiment wherein the protecting member 21 is mounted to the cover 14, the size and the weight of the protecting member 21 may be reduced, as compared with the case in which the protecting member is mounted to the housing 11.

The present invention may be modified in various manners as exemplified below.

Figure 4:
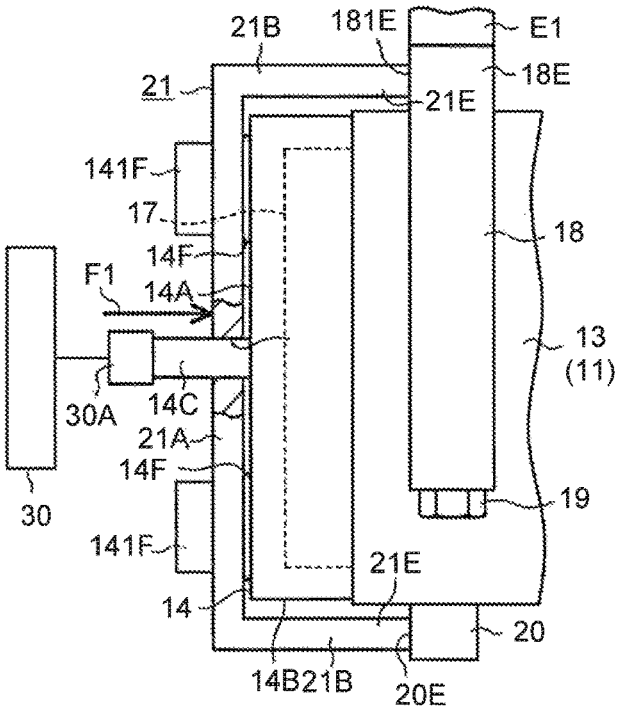
FIG. 4 is a partial schematic view showing an on-vehicle electric compressor mounted in an engine compartment of a vehicle according to another embodiment.

As shown in FIG. 4, it may be so configured that the cover 14 has a connecting portion 14C that is connected to an external connector 30A of an external power source 30 and the protecting member 21 is formed with a hole 21H through which the connecting portion 14C is inserted. In this configuration, the connecting portion 14C inserted through the hole 21H prevents the protecting member 21 from falling off from the cover 14 even if the protecting member 21 and the cover 14 are disconnected from each other by the application any external force F1 to the protecting member 21.

Figure 5:
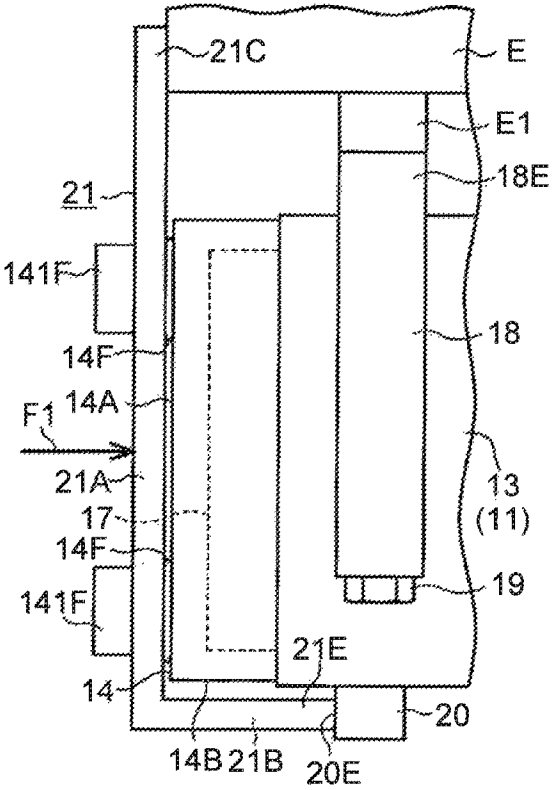
FIG. 5 is a partial schematic view showing an on-vehicle electric compressor mounted in an engine compartment of a vehicle according to still another embodiment.

As shown in FIG. 5, it may be so configured that the protecting member 21 has a contact portion 21C that is contactable with the engine E when the protecting member 21 receives the external force F1. In this case, the engine E acts as the receiving portion having higher rigidity than the cover 14.

Figure 6:
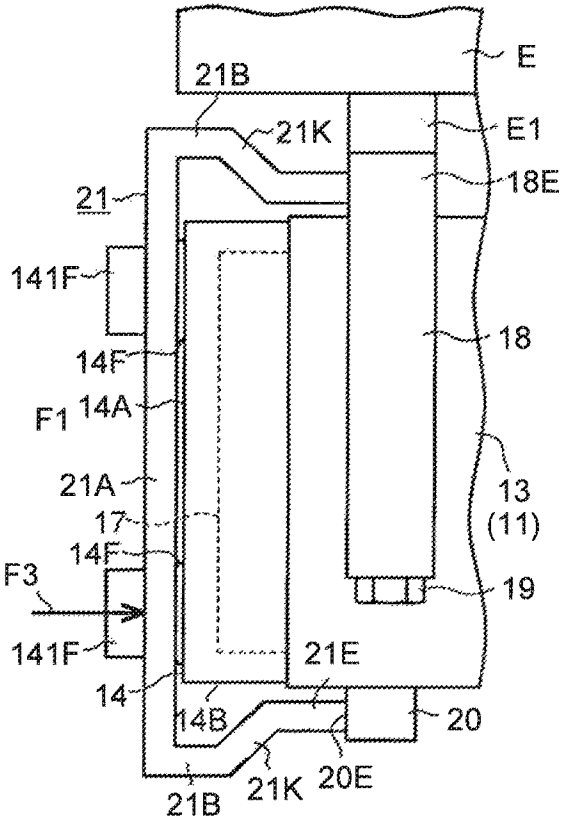
FIG. 6 is a partial schematic view showing an on-vehicle electric compressor in an engine compartment of a vehicle according to yet another embodiment.

As shown in FIG. 6, the protecting member 21 may have a portion 21K that is bent in such a manner that the spaced distance between the protecting member 21 and the cover 14 increases toward the first protecting portion 21A from the end portion 21E of the second protecting portion 21B. Such configuration of the protecting member 21 may permit the external force F3, which is applicable to the first protecting portion 21A at a position that is adjacent to the portion 21K, to act as moment to rotate the protecting member 21 about the cover 14. Thus, the protecting member 21 is less likely to be brought into contact with the cover 14, so that the transmission of the external force F3 through the protecting member 21 to the cover 14 is easily prevented.

The protecting member 21 may have a contacting member that is contactable with the mounting portions E1 of the engine E when the external force F1 is applied to the protecting member 21. In this case, the mounting portions E1 serves as the receiving portion having a greater rigidity than the cover 14.

The cover 14 may be made of any material as long as the mounting leg 18 and the projection 20 have greater rigidity than the cover 14.

The protecting member 21 may be mounted to the cover 14 with a fastener such as bolts.

The cover 14 may be formed by any material if the mounting leg 18 and the projection 20 have greater rigidity than the cover 14.

The protecting member 21 may be mounted to the cover 14 with a mounting part such as a bolt.

It may be so configured that the spaced distance L1 and the spaced distance L2 shown in FIG. 2 are substantially the same.

The number of the seats 14F is not limited. The cover 14 may dispense with the seat 14F. The projection 20 may be omitted. The second protecting portion 21B may be formed in a cylindrical shape.

Either one of the paired second protecting portions 21B may be omitted.

The peripheral wall 14B may be formed extending in any direction that intersects the bottom wall 14A.

What is claimed is:

1. An on-vehicle electric compressor comprising:

a compression mechanism compressing a refrigerant;

an electric motor driving the compression mechanism;

a housing accommodating therein the compression mechanism and the electric motor;

a motor driving circuit driving the electric motor;

a cover fixed to the housing, wherein the motor driving circuit is disposed between the housing and the cover; and a protecting member protecting the cover for the motor driving circuit against an external force caused when the vehicle has a collision, the cover includes a seat which projects out from the cover and the protecting member is placed on the seat, the cover and the protecting member are integrated with each other, in such a way that a protruded portion of the seat is inserted in a hole of the protecting member, while the cover and the protecting member are spaced apart by the projection of the seat, the protecting member has a contact portion, and the housing has a receiving portion, the receiving portion having a greater rigidity than the cover to receive the external force through the contact portion, wherein a surface of the contact portion and a surface of the receiving portion face each other in an axial direction of the housing with a space provided between the surface of the contact portion and the surface of the receiving portion, wherein a distance (L1) of the seat from an outer surface of a bottom wall in the axial direction of the housing is greater than a distance (L2) of the space between the surface of the contact portion and the surface of the receiving portion, so that the contact portion and the receiving portion are not in contact with each other before the external force is applied to the protecting member and that the contact portion and the receiving portion come into contact with each other when the external force is applied to the protecting member, thereby deforming the seat.

2. The on-vehicle electric compressor according to claim 1, wherein the cover includes a bottom wall and a peripheral wall extending from the bottom wall in a direction that intersects the bottom wall, wherein the protecting member includes a first protecting portion that covers at least a part of the bottom wall and a second protecting portion that extends from the first protecting portion to have the peripheral wall disposed therebetween and covers at least a part of the peripheral wall, and wherein the second protecting portion has the contact portion.

3. The on-vehicle electric compressor for the vehicle according to claim 2, wherein the contact portion comes into contact with the receiving portion at a periphery of the housing beyond the cover in the axial direction of the housing when the external force is applied to the protecting member.

4. The on-vehicle electric compressor according to claim 1, wherein the cover is made of a resin, and part of the protecting member is held by the cover so that the protecting member and the cover are integrated.

5. The on-vehicle electric compressor according to claim 1, wherein the cover has a connecting portion that is connected to an external connector of an external power source, and the protecting member is formed with a hole through which the connecting portion is inserted.

6. The on-vehicle electric compressor according to claim 1, wherein the receiving portion includes:

a mounting leg extending perpendicularly to the axial direction of the housing and projecting out from an outer peripheral surface of the suction housing, and a projection projecting from the outer peripheral surface of the suction housing at a location separate from the mounting leg, wherein, before the external force is applied to the protecting member, a surface of the mounting leg and a surface of the projection are disposed in a same plane so that the contact portion is spaced apart from the mounting leg and the projection by a same distance.

* * * * *